US007516513B1

(12) United States Patent
Powell et al.

(10) Patent No.: US 7,516,513 B1
(45) Date of Patent: Apr. 14, 2009

(54) ADJUSTABLE ENGAGEMENT GLIDE DEVICE AND METHOD

(76) Inventors: Gregory S. Powell, 500 Linne Rd., Unit B, Paso Robles, CA (US) 93446; Robin Marks, 548 Hill St., San Luis Obispo, CA (US) 93405

( * ) Notice: Subject to any disclaimer, the term of this patent is extended or adjusted under 35 U.S.C. 154(b) by 362 days.

(21) Appl. No.: 11/161,886

(22) Filed: Aug. 20, 2005

(51) Int. Cl.
*A47B 91/06* (2006.01)

(52) U.S. Cl. ..... 16/42 T; 16/42 R

(58) Field of Classification Search ..... 16/42 T, 16/42 R, 43; 248/188.9
See application file for complete search history.

(56) References Cited

U.S. PATENT DOCUMENTS

| | | | | | |
|---|---|---|---|---|---|
| 811,163 | A | * | 1/1906 | Morsier | 411/15 |
| 1,843,261 | A | * | 2/1932 | Bales | 248/188.9 |
| 2,513,193 | A | * | 6/1950 | Miller | 16/38 |
| 2,738,541 | A | * | 3/1956 | Thornsbury | 16/42 R |
| 2,860,368 | A | * | 11/1958 | Thornsbury | 16/42 R |
| 5,191,676 | A | * | 3/1993 | Gerner | 16/42 T |
| 5,933,889 | A | * | 8/1999 | Eekhoff | 5/611 |
| 5,991,974 | A | | 11/1999 | Carpinella | |
| 6,154,923 | A | | 12/2000 | Carpinella | |
| 6,219,882 | B1 | | 4/2001 | Olson | |
| 6,324,725 | B1 | | 12/2001 | Green | |
| D487,392 | S | | 3/2004 | Chase | |
| 6,719,256 | B2 | | 4/2004 | Rydell et al. | |
| 6,910,246 | B2 | | 6/2005 | Desmarais | |

* cited by examiner

*Primary Examiner*—Victor Batson
*Assistant Examiner*—Jeffrey O'Brien
(74) *Attorney, Agent, or Firm*—William Keyworth; Bill & Mary Lou Inc.

(57) ABSTRACT

An adjustable engagement glide is quickly and removably engaged with tubular products to finish the product end and function as a cap, foot, bumper, or scratch protector on products such as furniture, shop and transportation products, and racks and displays. Engagement is by deformation of a resilient bushing frictionally engaging the tubular product inserted in the glide. The glide is configured for severe service without breakage, has provision to protect surfaces upon which it is supported, but may also be easily disengaged from the product for replacement.

12 Claims, 8 Drawing Sheets

ADJUSTABLE ENGAGEMENT GLIDE DEVICE AND METHOD

CROSS-REFERENCE TO RELATED APPLICATIONS

Not Applicable.

STATEMENT REGARDING FEDERALLY SPONSORED RESEARCH AND DEVELOPMENT

Not Applicable.

REFERENCE TO A MICROFICHE APPENDIX

Not Applicable.

BACKGROUND OF THE INVENTION

1. Field of the Invention

This application relates to a glide and the method of installing the glide on tubular products to provide adjustable engagement that is releasable. A glide is an apparatus used in many industries to perform a variety of functions. Most commonly glides are used to finish the end of a tubular product, and function as caps, feet, bumpers, or scratch protectors on products such as furniture, shop and transportation products, and racks and displays. In this patent application tubular products are construed to include hollow materials with circular, elliptical, rectangular, or other conic or polygon cross-section.

2. Description of Related Art

Glides are well known in the art as devices for providing a finishing device on a tubular product to prevent injury due to sharp surfaces, to prevent scratching of surfaces in contact with the tubular product, to reduce noise caused by contact with the end of a tubular product, and to provide a finished look to a tubular product.

The prior art glides use a frictional attachment to the tubular product that is intended to provide a semi-permanent attachment. These are prone to wear when in severe services that are prone to impact and vibration, and thus may become loose or missing in such service. Alternately, if the glide is complicated in design, such as those that swivel, the glide may become broken and the broken glide may be difficult to remove from the tubular product. Glides that use this type of attachment in furniture service are taught in U.S. Pat. Nos. 5,991,974 (Carpinella), 6,154,923 (Carpinella), 6,219,882 (Olson), 6,324,725 (Green), 6,719,256 (Rydell et al.), 6,910,246 (Desmarais).

The present invention overcomes these disadvantages of the prior art by providing a glide that is sturdy, is installed with adjustable engagement with the tubular product, and may be disengaged from the tubular product when desirable.

SUMMARY OF THE INVENTION

This invention is an adjustable engagement glide for installation on a tubular product. The glide has a main body, a bolt with a head portion and a threaded portion, a bushing, and a bushing deformation nut.

The main body is a single piece with an outer surface, an inner surface, an attachment extension also with an inner surface and an outer surface, and also with a first end engaged with the body inner surface, and a second end. A countersink opening is arranged between the outer surface and the inner surface of the main body such that the opening is centrally arranged with the attachment extension first end.

The bushing has a first end and a second end, an outside surface, and a through-hole arranged between the first and second ends, the through-hole arranged so the bolt threaded portion fits within the hole. The bushing deformation nut is arranged with a threaded portion to threadedly engage the bolt threaded portion and the bolt is arranged with the bolt head in the main body countersink opening. This allows the bolt threaded portion to extend centrally into the attachment extension and through the bushing through-hole, thus forming an installation annulus between the attachment extension inner surface and the bushing outside surface.

The bushing deformation nut is in frictional engagement with the bushing by placing a slight pretension with the bolt. Turning the bolt head in the tightening direction causes the nut to compressively engage the bushing, and turning the bolt head in the opposite direction releases the compressive engagement of the bushing. When the tubular product is inserted in the installation annulus and the bolt head turned to compressively engage the bushing, deformation of the bushing causes adjustable engagement with the tubular product.

The body inner surface forms a concavity around the attachment extension with a concavity end arranged such that the attachment extension is located within the main body concavity. This concavity allows impact forces to the glide to be absorbed by elastic deformation of the glide rather than damaging the glide.

An upper body is arranged to engage the main body at the concavity end and further arranged to engage the attachment extension at the extension second end. It thus encloses the main body from the concavity end to the attachment extension second end. This provides an attractive, finished appearance to the glide and reduces the exposed crevices prone to the collection of dirt.

The glide bolt and nut is pretensioned prior to installation so that the friction of the bushing on the nut assures tightening the bolt turns it within the nut threads and deforms the bushing, rather than spinning the nut without engagement with the bushing. The glide is installed by inserting the tubular product end into the installation annulus such that the tubular product end contacts the installation annulus bottom end, and then tightening the bolt such that the tubular product is forced into adjustable engagement between the bushing and attachment extension inner surface. Alternately the pretension may be adjusted to give a press-on fit to the tubular product. In this alternative sufficient force is applied to insert the tubular product end between the attachment extension inner surface and the bushing.

OBJECTS AND ADVANTAGES

One object of the present invention is to provide a guide that is easily and adjustably engaged with tubular products.

A second object of the present invention is to provide a guide that resists breakage in severe service, but is easily removed for replacement.

BRIEF DESCRIPTION OF THE SEVERAL VIEWS OF THE DRAWINGS

A more complete understanding of the present invention can be obtained by considering the detailed description in conjunction with the accompanying drawings, in which.

REFERENCE NUMERALS IN DRAWINGS

Figure 1:
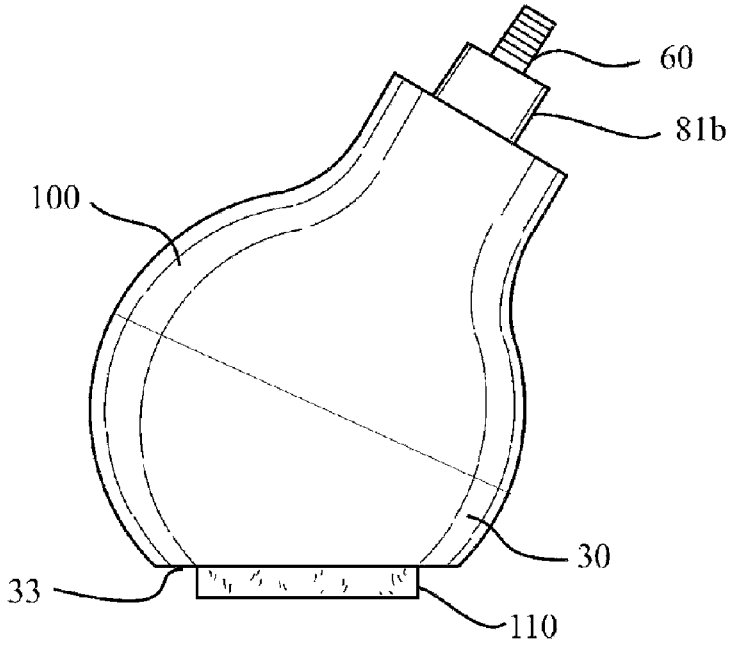
FIG. 1 is a side view of an angled glide with a first embodiment of the attachment means.

These reference numbers are used in the drawings to refer to areas or features of the invention.

30 Main Body
32 Main Body Outer Surface
33 Main Body Surface Contact Area
34 Main Body Inner Surface
40 Main Body Concavity
42 Main Body Concavity End
44 Main Body Attachment Extension
45 Main Body Attachment Extension Inner Surface
45*b* Main Body Attachment Extension Outer Surface
46 Main Body Attachment Extension First End
48 Main Body Attachment Extension Second End
50 Main Body Countersink Opening
60 Bolt
62 Bolt Head Portion
64 Bolt Threaded Portion
70 Bushing
70*a* Molded Bushing
70*b* Sleeve Bushing
72 Bushing Through Hole
74 Bushing First End
76 Bushing Second End
78 Bushing Outside Surface
80 Bushing Deformation Nut
80*a* Molded Bushing Nut
80*b* Sleeve Bushing Wedge Nut
81*b* Sleeve bushing Wedge Nut Holder
82 Bushing Deformation Nut Threaded Portion
90 Installation Annulus
92 Installation Annulus Bottom End
94 Installation Annulus Entry End
100 Upper Body
102 Upper Body First End
104 Upper Body Second End
110 Surface Protection Attachment
120 Tubular Product

DETAILED DESCRIPTION OF THE INVENTION

Figure 2:
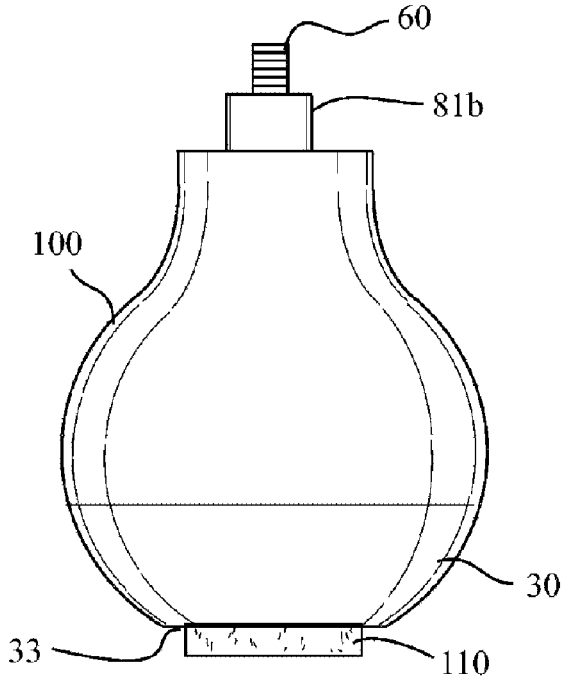
FIG. 2 is a side view of a straight glide with a first embodiment of the attachment means.
Figure 3:
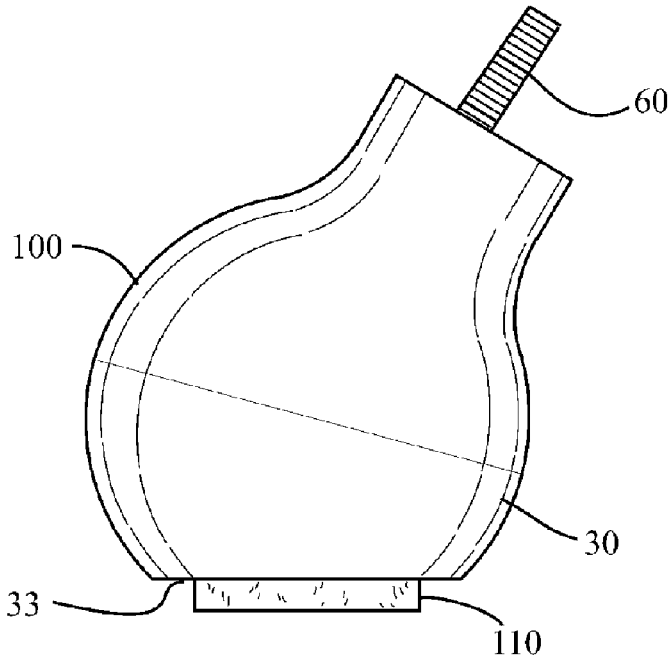
FIG. 3 is a side view of an angled glide with a second embodiment of the attachment means.
Figure 4:
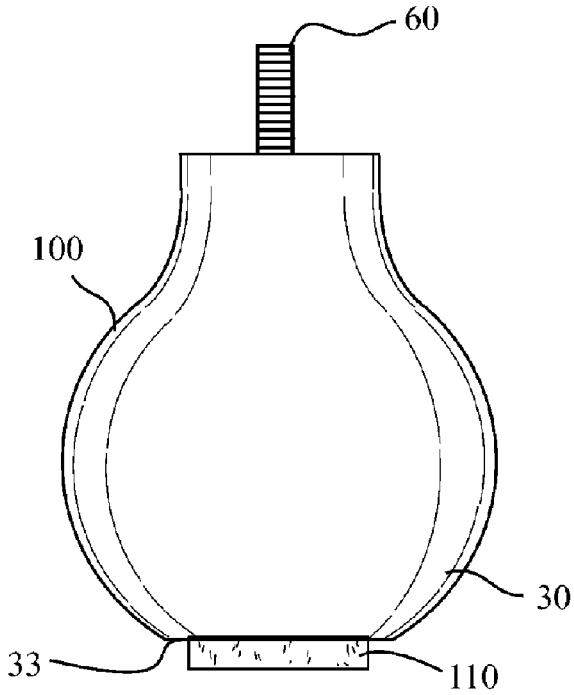
FIG. 4 is a side view of a straight glide with a second embodiment of the attachment means.
Figure 5:
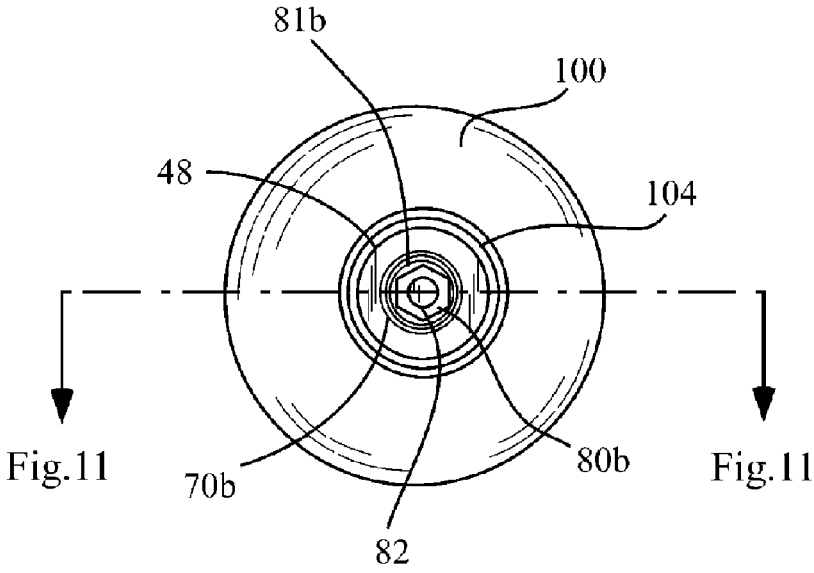
FIG. 5 is a top view of a straight glide with a first embodiment of the attachment means.
Figure 6:
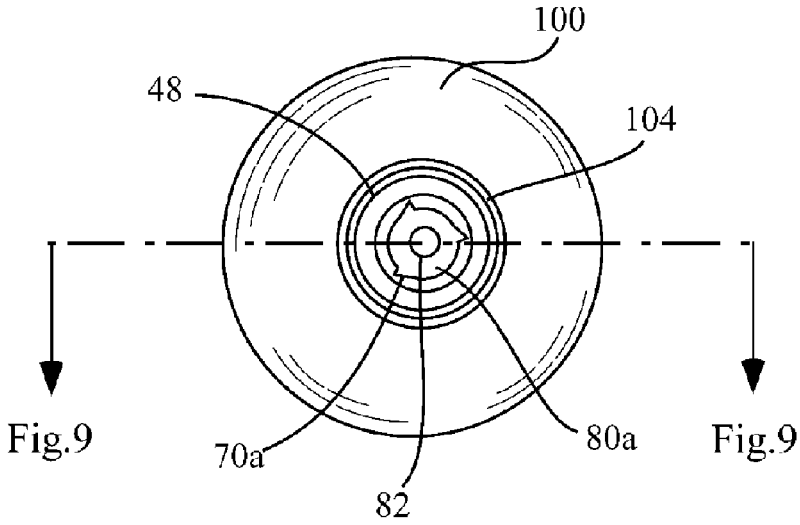
FIG. 6 is a top view of a straight glide with a second embodiment of the attachment means.
Figure 7:
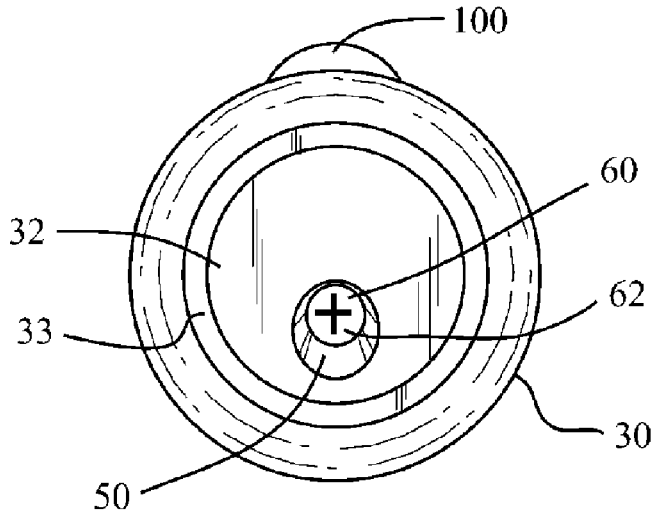
FIG. 7 is a bottom view of an angled glide with a first embodiment of the attachment means.
Figure 8:
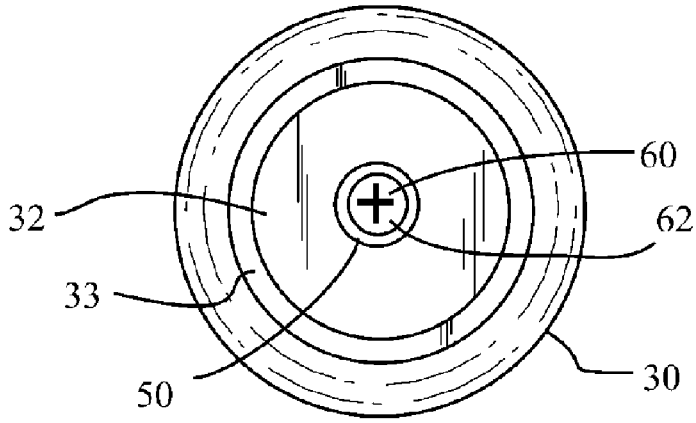
FIG. 8 is a bottom view of a straight glide with a second embodiment of the attachment means.

The assembled adjustable engagement glide is shown in side views of two models in FIGS. 1, 2, 3, and 4, FIGS. 1 and 3 show the model for engagement with an angled tubular product, such as might be used on a chair leg that meets the supporting surface at an angle, and FIGS. 2 and 4 the second model for engagement with a straight tubular product, such as might be used for a table or chair leg that is vertical with the supporting surface on which it rests. FIGS. 5 and 6 show a top view of the glide for a straight tubular product. There is shown in FIGS. 1 through 6 a first and a second embodiment of attachment means to the tubular product. The first embodiment is shown in FIGS. 1, 2, and 5, the second embodiment in FIGS. 3, 4, and 6. Bottom views of the two models, straight and angled, are shown in FIGS. 7 and 8 respectively.

Figure 9:
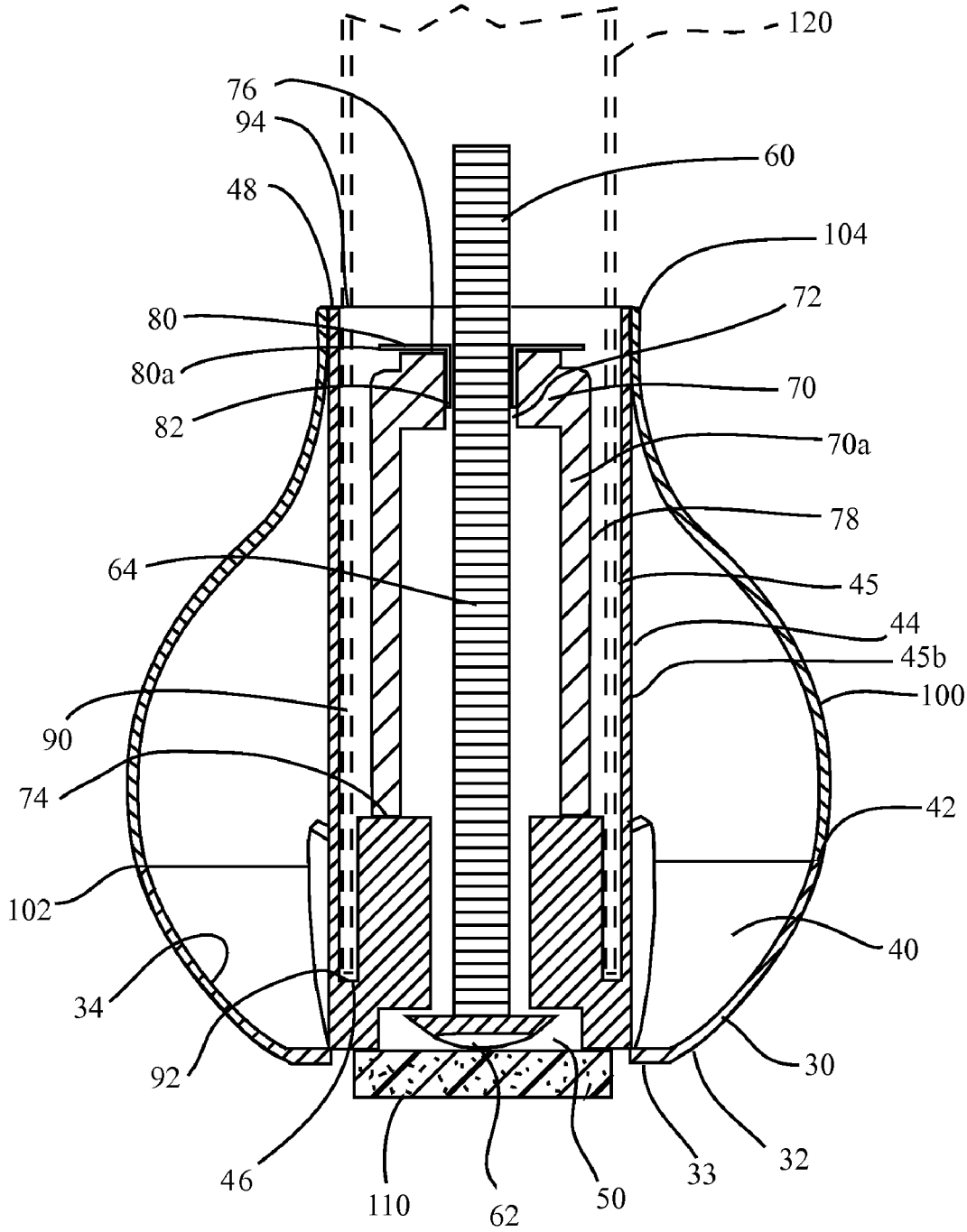
FIG. 9 is a cut-away view of a straight glide with a second embodiment of the attachment means. The tubular product is shown in dashed lines as inserted in the glide.
Figure 10:
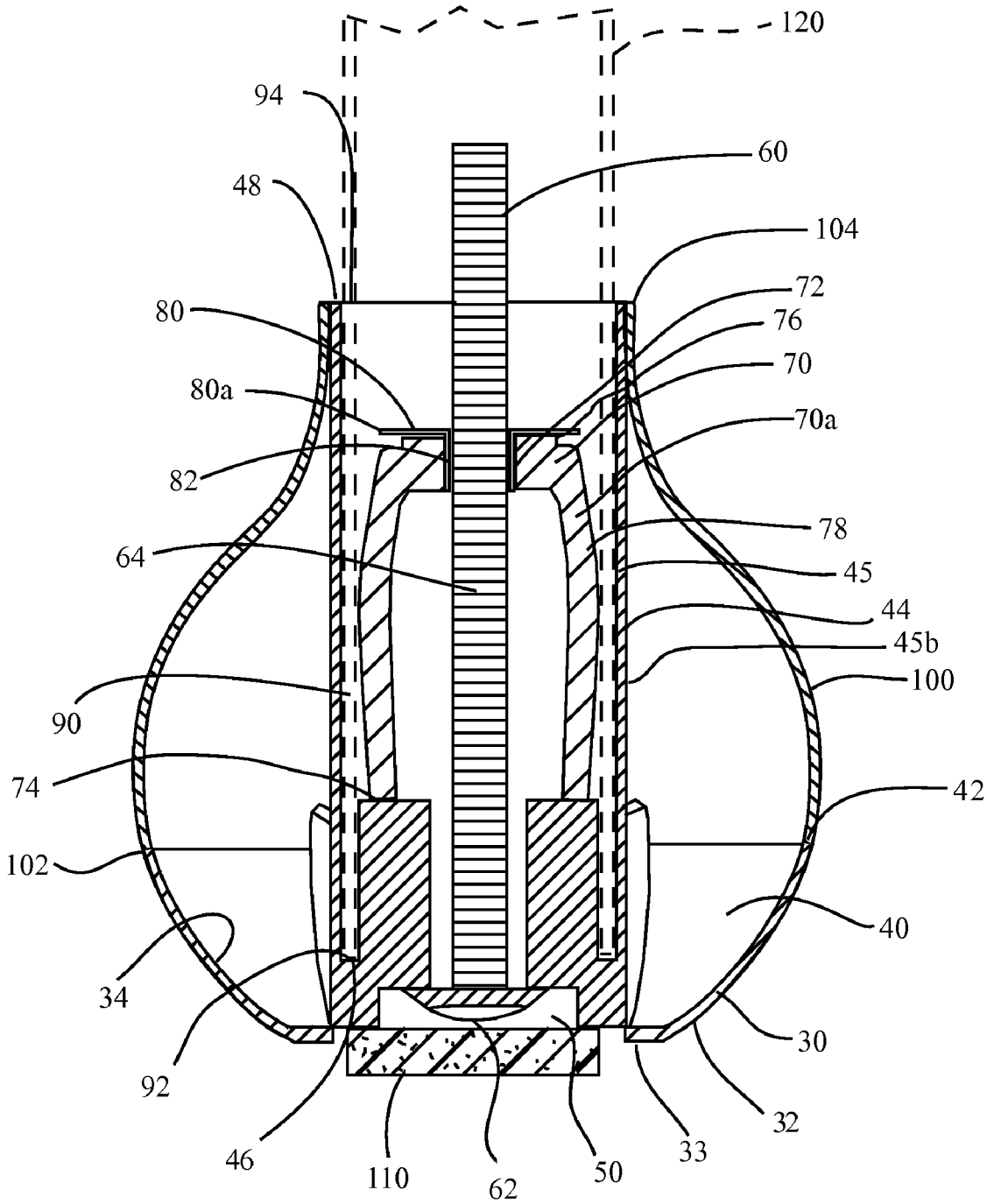
FIG. 10 is a cut-away view of a straight glide with a second embodiment of the attachment means showing the glide engaged with a tubular product. The tubular product is shown in dashed lines as inserted in the glide.
Figure 11:
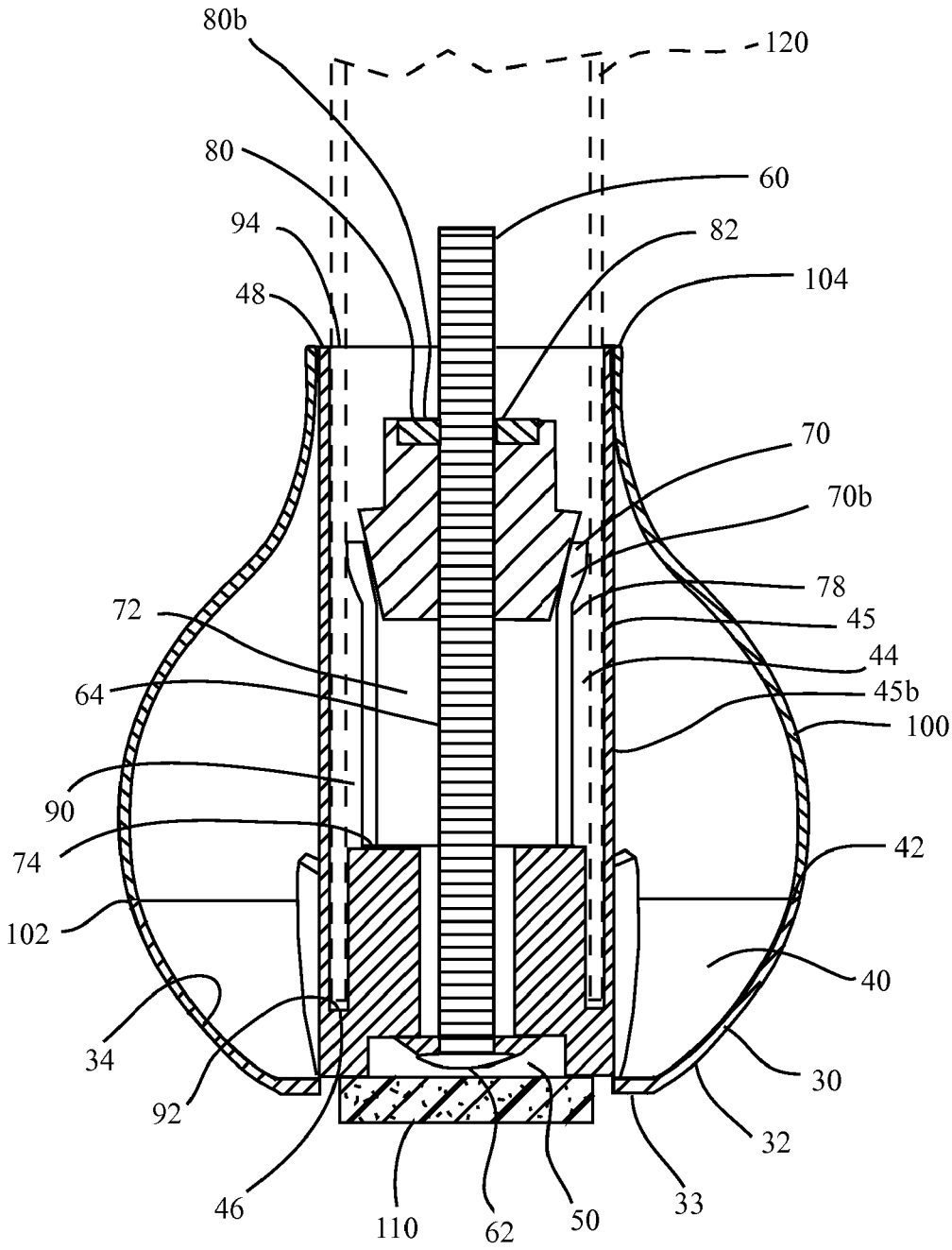
FIG. 11 cut-away view of a straight glide with a first embodiment of the attachment means showing the glide engaged with a tubular product. The tubular product is shown in dashed lines as inserted in the glide.

In either model, straight or angled, the glide has a main body (30) and an upper body (100) joined to form a unitary structure. The main body contains the adjustable engagement means that consists of the items shown in cut-away views in FIGS. 9, 10 and 11, and in exploded view in FIG. 12. The upper body encloses the main body structure and is joined by welding or glue to form the unitary structure. The main body is molded with an attachment extension portion and a concavity portion. The concavity portion has an outer surface (32), and an inner surface (34). The inner surface contains a concavity (40) with a concavity end (42) that is also one attachment point for the upper body (100). The concavity may contain structural ribs to enhance the geometric stability of the glide, and the concavity also functions to allow elastic deformation of the glide due to impact forces, providing impact absorption in severe service. This provides means for absorbing impact forces normal to the tubular product axis on a surface offset from and surrounding the tubular product as shown in FIGS. 9, 10 and 11. The concavity inner surface is also integral with the attachment extension portion that has an attachment extension (44) with a first end (46) where it is molded with the concavity portion inner surface to form the main body, and a second end (48) that is the second attachment point for the upper body (100). Between the main body outer and inner surface there is a countersink opening (50) located centrally in the attachment extension first end (44). The countersink opening is sized to allow through passage of the bolt threaded portion (64) while keeping the bolt head portion (62) within the countersink. The opening may not include a countersink in which case the bolt head portion (62) may protrude from the main body outer surface.

The engagement means is shown in cross-sectional view of a first embodiment in FIG. 9 and the same embodiment engaged with a tubular product in FIG. 10. A second embodiment of the engagement means is shown in cross-sectional view in FIG. 11. The engagement means is located within the main body attachment extension (44) and consists of the bolt (60) with a head portion (62), which is the means for adjusting the engagement means, located within the countersink opening (50) and the threaded portion (64) extending centrally into the attachment extension. A bushing (70) with a through hole (72) located between the first end (74) and the second end (76) is installed around the bolt threaded portion (64), and a bushing deformation nut (80) with a threaded portion (82), which mates with the threads of the bolt threaded portion (64), is installed at the bushing second end (76). In the embodiment shown in FIGS. 9 and 10 the molded bushing nut (80*a*) acts on the molded bushing second end (76) to deform the bushing. In the embodiment shown in FIG. 11 the sleeve bushing wedge nut (80*b*) acts on the bushing through hole (72) to deform the bushing. The space between the attachment extension (44) and the bushing (70) forms an installation annulus (90) into which the tubular product onto which the glide is to be engaged may be inserted. This annulus has a bottom end (92) formed by the main body inner surface (34) and an entry end (94) that provides opening means for inserting the tubular product into the glide. The annulus may be shaped generally like the tubular product to which the glide is to be installed or any shape that fosters frictional engagement of the tubular product between the attachment extension inner surface and the bushing. The bushing is made of a resilient deformable material (example soft plastic, rubber). The bolt (60) and bushing deformation nut (80) are pretensioned to provide a deformation of the bushing (70) so that the nut's frictional engagement with the bushing allows turning the bolt without turning the nut, thus moving the nut axially along the bolt threads and allowing the bushing to be further compressively deformed, or the deformation relaxed. The bolt head, that is the means for adjusting the engagement means, is turned from the exterior surface of the main body using well known tools. Alternately the pretension may be adjusted to provide an installation annulus (90) that is a desired dimension smaller than the wall thickness of the tubular product (120). This arrangement provides a press-on fit for installing the guide on the tubular product.

Figure 12:
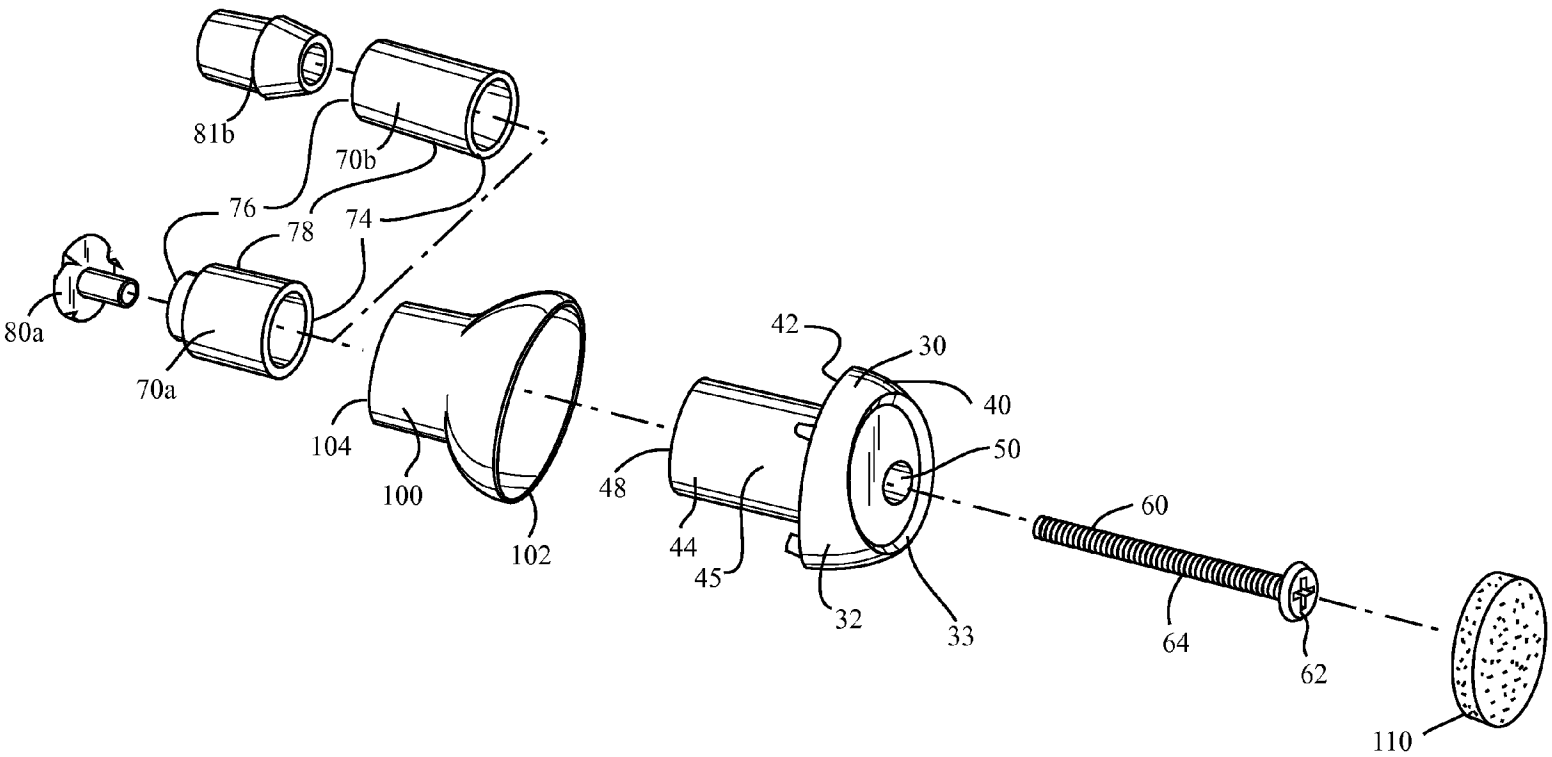
FIG. 12 is an exploded view of an angled glide showing both a first and second embodiment of the attachment means.

Two embodiments of the engagement means are shown in FIG. 12. One using a molded bushing (70*a*) and the second using a sleeve bushing (70*b*). Each embodiment uses a different arrangement of the bushing deformation nut (80), the first embodiment has a molded bushing nut (80*a*) with means for engaging the molded bushing second end (76), the second embodiment has a sleeve bushing wedge nut (80*b*) with means for engaging the hole in the sleeve bushing at the bushing second end (76).

Operation

The adjustable engagement glide is installed on a tubular product by inserting the glide installation annulus on the tubular product so the product end is on the bottom end of the installation annulus (92). The bolt (60) is then turned in the tightening direction in the bushing deformation nut (80) so the bushing (70) is deformed between the bolt and nut. The tightening is continued until the bushing deforms sufficiently to press against the tubular product forming a frictional bond with the product. The glide is then adjustably frictionally engaged with the product in that the frictional engagement with the tubular product may be adjusted by the bolt.

Alternately the pretension may be adjusted to provide an installation annulus (90) that is a desired dimension smaller than the wall thickness of the tubular product (120). This provides a press-on fit that requires application of sufficient force to the glide to overcome the frictional resistance of the bushing and press the glide on the tubular product. The glide is then adjustably frictionally engaged with the product in that the frictional engagement with the tubular product may be adjusted by the bolt.

A surface protection attachment (110) may be installed by adhesive or other common attachment method on the main body surface contact area (33) for service where scratch-resistance is desired. This means for surface protection may be a non-scratching soft material (example felt) or a low friction material (examples polyethelene or Teflon) that provides an interface that will not damage the surface with which the glide is in contact.

A means for adjustment after installation or removal of the adjustable engagement glide may be done by removing any surface protection attachment installed on the glide and turning the bolt head. Removal requires turning in the loosening direction until the deformation of the bushing is released sufficiently to disengage the bushing from the tubular product, at which point the glide may be slid off the tubular product.

ADDITIONAL EMBODIMENTS

Those familiar with the art recognize there are many possible applications and variations for the adjustable engagement glide other than the embodiments recited. The glide may vary in geometric shape to provide other uses from those taught, or may use different contact configurations to achieve deformation of the bushing by tightening the nut on the bolt such as a nut and washer, a spherical contact surface, a bushing wedge located in the main body inner surface to which the bushing is drawn against, etc. The glide may also have the pretension on the bushing adjusted to provide a press-on fit to the tubular product in these alternative arrangements. A press-on fit provides sufficient friction on the tubular product to resist removal of the installed guide. This embodiment is installed with sufficient force to press the tubular product wall into the installation annulus. This recitation of the preferred and other embodiments is not intended to define or constrain the invention; rather the claims define the invention.

What is claimed is:

1. An adjustable engagement glide installed on a tubular product end with a known outside surface shape that is substantially normal to the tubular product axis comprising:

a. a single-piece main body, a bolt with a head portion and a threaded portion, a bushing, and a bushing deformation nut;

b. the single-piece main body comprising a concavity with an outer surface, an inner surface, and a surface contact area, and an attachment extension with an inner surface arranged in the shape of the tubular product outside surface, an outer surface, a first end at the concavity surface contact area, and a second end with an opening arranged to contain the bushing and bushing deformation nut within the inner surface and within the attachment extension ends, and further arranged for insertion of the tubular product end inside the inner surface, wherein the inner surface of the attachment extension is arranged to contact the outside surface of the tubular product, an opening centrally arranged with the attachment extension first end and sized larger than the bolt threaded portion and smaller than the bolt head;

c. the bushing with a first end and a second end, an outside surface, and a through-hole arranged between the first and second ends, the through-hole arranged such that the bolt threaded portion fits within the hole;

d. the bushing deformation nut arranged with a threaded portion to threadedly engage the bolt threaded portion;

e. the bolt arranged with the bolt head protruding from the main body attachment extension first end opening such that the bolt threaded portion extends centrally into the attachment extension wherein the bushing through-hole is around the bolt, forming an installation annulus between the attachment extension inner surface and the bushing outside surface;

f. the bushing deformation nut further arranged in frictional engagement with the bushing second end such that turning the bolt head in one direction causes the nut to compressively engage the bushing and turning the bolt head in the opposite direction releases the compressive engagement of the bushing, wherein with the tubular product fully inserted into the installation annulus and the glide fully installed, the compressive engagement of the bushing on the tubular product is adjustable; and g. the concavity inner and outer surfaces arranged in a hollow concavity initiating from the attachment extension first end and beginning with a surface contact area, then curving toward the attachment extension second end, and terminating in a concavity end offset from the attachment extension containing the tubular product.

2. The adjustable engagement glide of claim 1 further comprising an upper body with a first end and a second end, and arranged to engage the main body at the concavity end and further arranged to engage the attachment extension at the extension second end wherein the upper body portion is separated from the tubular product by enclosing the main body from the concavity end to the attachment extension second end.

3. The adjustable engagement glide of claim 1 further comprising the main body surface contact area containing a surface protection attachment.

4. The adjustable engagement glide of claim 2 further comprising the upper body is joined to the main body at the concavity end and at the extension second end.

5. The adjustable engagement glide of claim 2 further comprising a main body surface contact area with a surface protection attachment.

6. The adjustable engagement glide of claim 4 further comprising the main body surface contact area with a surface protection attachment.

7. The adjustable engagement glide of claim 1 further comprising the bolt head contained in a countersunk attachment extension first end opening.

8. The adjustable engagement glide of claim 2 further comprising the bolt head contained in a countersunk attachment extension first end opening.

9. The adjustable engagement glide of claim 4 further comprising the bolt head contained in a countersunk attachment extension first end opening.

10. The adjustable engagement glide of claim 8 further comprising a main body surface contact area with a surface protection attachment.

11. The adjustable engagement glide of claim 9 further comprising a main body surface contact area with a surface protection attachment.

12. An adjustable engagement glide for installation on and support of a tubular product end, that is substantially normal to the tubular product axis, on a surface comprising:

a. means for engaging the tubular product in the glide;

b. means for adjusting the engagement of the tubular product following installation of the glide; and c. means for absorbing impact forces normal to the tubular product axis on a surface offset from and surrounding the tubular product.

* * * * *